US007700055B2

(12) United States Patent
Manabe et al.

(10) Patent No.: US 7,700,055 B2
(45) Date of Patent: Apr. 20, 2010

(54) HYDROGEN COMBUSTION SYSTEM

(75) Inventors: Akiyoshi Manabe, Tamano (JP); Masaaki Kato, Tamano (JP); Kazumasa Mochizuki, Tamano (JP); Masakazu Mimura, Tamano (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 369 days.

(21) Appl. No.: 11/878,054

(22) Filed: Jul. 20, 2007

(65) Prior Publication Data

US 2008/0025886 A1 Jan. 31, 2008

(30) Foreign Application Priority Data

Jul. 28, 2006 (JP) ..... 2006-206079
Aug. 23, 2006 (JP) ..... 2006-226347
Nov. 6, 2006 (JP) ..... 2006-299993

(51) Int. Cl.

| | |
|---|---|
| ***B01J 8/02*** | (2006.01) |
| ***B01J 8/04*** | (2006.01) |
| ***G21C 9/00*** | (2006.01) |
| ***G21C 19/30*** | (2006.01) |
| ***C01B 5/00*** | (2006.01) |
| ***F23D 14/18*** | (2006.01) |

(52) U.S. Cl. ..... 422/211; 422/188; 422/190; 422/191; 423/580.1; 376/300; 376/301; 976/DIG. 271

(58) Field of Classification Search ..... 422/211, 422/190, 191, 188; 376/300, 301; 423/580.1; 976/DIG. 271

See application file for complete search history.

(56) References Cited

U.S. PATENT DOCUMENTS 4,008,050 A * 2/1977 Betz ..... 422/192

(Continued)

FOREIGN PATENT DOCUMENTS

JP 3-38523 U 4/1991

(Continued)

OTHER PUBLICATIONS

Machine translation of JP-2000291917A—Sep. 17, 2009.*

*Primary Examiner*—Walter D Griffin
*Assistant Examiner*—Huy-Tram Nguyen
(74) *Attorney, Agent, or Firm*—Kubovcik & Kubovcik

(57) ABSTRACT

A hydrogen combustion system comprising: an external cylinder 1 constituting the exterior of a double tube construction; an internal cylinder 2 formed by a porous metal plate constituting the interior of said double tube construction; hydrogen combustion catalyst 4 supported with precious metals on spherical ceramic support surface, formed in pellet state, being packed in said internal cylinder 2; an insert pipe 3 formed by porous metal plate inserted in the center of said internal cylinder 2; pre-heating heaters 5 installed between said insert pipe 3 and said internal cylinder 2 to preheat said hydrogen combustion catalyst 4 to ambient atmosphere of over catalytic reaction temperatures; a hydrogen introducing port 8 connecting to said insert pipe 3; an air introducing port 9 provided at the bottom of said external cylinder 1 in the area between said external cylinder 1 and said internal cylinder 2, wherein air for hydrogen combustion is introduced by the drift effect resulting from the differential pressure generated between the packed layer of hydrogen combustion catalyst and the outside, by thermal convection, achieving safe combustion treatment of hydrogen in simple construction, small size and high treatment efficiency.

4 Claims, 7 Drawing Sheets

U.S. PATENT DOCUMENTS

| | | | | | |
|---|---|---|---|---|---|
| 4,048,387 | A | * | 9/1977 | Lahme et al. | 429/50 |
| 4,246,235 | A | * | 1/1981 | Rogers | 422/198 |
| 4,302,360 | A | * | 11/1981 | Haruta et al. | 502/324 |
| 4,662,352 | A | * | 5/1987 | Aviles, Jr. | 126/204 |
| 2004/0126647 | A1 | * | 7/2004 | Jones | 429/57 |

FOREIGN PATENT DOCUMENTS

| | | | |
|---|---|---|---|
| JP | 04-118042 | A | 4/1992 |
| JP | 10-220716 | A | 8/1998 |
| JP | 2000-291917 | A | 10/2000 |
| JP | 2005-274063 | A | 10/2005 |

* cited by examiner

HYDROGEN COMBUSTION SYSTEM

BACKGROUND OF THE INVENTION

1. Field of the Invention

The invention relates to a hydrogen combustion system which treats hydrogen by combustion with hydrogen combustion catalyst. More specifically, it relates to a hydrogen combustion system suitable for reacting excess hydrogen gases safely, including, though having no restriction as to kinds of feed hydrogen gases to be combusted, extra hydrogen gas generated during an operation of fuel cells, ambient atmosphere hydrogen gas at a film forming step in semiconductor processes, electrolytically by-produced hydrogen gas from a water electrolysis system, by-product hydrogen gas from chemical reaction processes, to be discharged as water vapor from the processes.

2. Description of the Related Art

In general, hydrogen gases by-produced in various processes, which intrinsically involve high possibilities of explosion and leakage hazard are discharged into ambient atmosphere via exclusively provided vent pipes or via common pipes after being diluted with air by units like a blower to a point below the combustible ranges.

However, these methods require additional installation and capital investment covering hydrogen gas vent piping, equipment and machinery like a blower, and introduction of discharge systems for securing safety. For a large-scale plant, installing these equipment and systems may be inevitable, but for a small-scale process, any safe and simple treatment method of hydrogen gas has been looked for.

In order to solve these problems, various kinds of hydrogen combustion systems have been proposed. As one of these conventional equipments, for instance, such a system has been known, as shown in FIG. 7, as hydrogen gas is blown to the air supplied by a blower 10 to generate gas mixture; then the gas mixture is passed through the treatment layer 11 loaded with catalyst-supported substance in pellet, granule, honeycomb, etc., during which hydrogen gas is combusted. (JP 3-38523 A-Utility Model)

As another hydrogen combustion treatment system by a conventional method, the system has been known, as shown in FIG. 8, comprising a catalyst supported, a membrane-state element of micro porosity with nearly uniform opening 12, a hydrogen chamber 13 and a duct part 14 formed on the both sides, and a hydrogen distribution nozzle 15 in the hydrogen chamber 13, wherein the membrane element 12 has a conformation of a fine mesh (approx 10-100 μm) stainless-steel filter with catalyst of platinum, etc. on the surface. In this system, hydrogen gas is introduced to a nozzle 15; while to the duct part 14, air is forcibly flown by a fan 16. Hydrogen gas is supplied to a hydrogen chamber 13 by a nozzle 15 dispersively, diffused at micro-uniform velocity on the membrane element 12, allowed to be in contact with catalyst at passing, mixed with air flowing in a duct part 14, and thus combustively treated. (JP 2000-291917 A)

However, in the system of JP 3-38523 A-Utility Model, hydrogen gas and air are mixed first and then the mixed gas with diluted hydrogen is supplied to the treatment layer 11 at a substantially increased flow rate for hydrogen; because of this feeding mode, a large resistance occurs when the mixed gas passes through the catalyst layer. As a result, a high pressure turbo-type blower is required and the volume of catalyst must be increased, which leads to a problem of high cost from enlarged equipment.

On the other hand, the system of JP 2000-291917 A employs, as hydrogen combustion catalyst, a membrane-state catalyst, not in pellet state, but of a fine mesh (approx 10-100 μm) stainless-steel filter with platinum catalyst, etc. on the surface. This system provides insufficient air convection within the hydrogen combustion system and the temperature in the hydrogen combustion system does not rise to a level necessary for hydrogen combustion. Accordingly, in order to achieve an efficient hydrogen combustion reaction, it is necessary to feed air for hydrogen combustion forcibly using a fan 16 to a duct part 14 of the hydrogen combustion system, which requires large electric power and equipment.

SUMMARY OF THE INVENTION

In order to solve the problems of the conventional methods, an object of the present invention is to provide an outstanding hydrogen combustion system of simple in construction and small in size with a maximum treatment efficiency through the methods in which; premixing the introduced hydrogen gas with air to dilute to the lowest level of the combustion range at supplying hydrogen gas to the hydrogen combustion system is not employed and thus pure state hydrogen gas is supplied to the system; the air necessary for the reaction is supplied by drift resulting from the differential pressure generated by thermal convection between the loading layer of hydrogen combustion catalyst and the external; hence a blower and a fan to feed reaction air forcibly are not required; and hydrogen gas is subject to combustion treatment safely; and the amount of flow of hydrogen gas from the upper side of the insert pipe 3 to the internal cylinder 2 is minimized so that hydrogen gas is blown out of the entire surface of the insert pipe 3 relatively uniformly; and at the same time, the catalyst loaded in the internal cylinder 2 is kept balanced optimally with the air flowing into the gap between the external cylinder 1 and the internal cylinder 2 to obtain the maximum hydrogen treatment capacity.

The present invention, intending to solve the above-mentioned problems, provides a hydrogen combustion system comprising an external cylinder 1 constituting the exterior of a double tube construction, an internal cylinder 2 formed by a porous metal plate constituting the interior of said double tube construction, hydrogen combustion catalyst 4 supported by precious metals on the spherical ceramic support surface being formed in pellet and loaded in said internal cylinder 2, an insert pipe 3 formed by a porous metal plate being inserted in the center of said internal cylinder 2, a pre-heating heater 5 located between said insert pipe 3 and said internal cylinder 2 to pre-heat said hydrogen combustion catalyst 4 to an ambient atmosphere of over catalytic reaction temperatures, hydrogen gas introducing port 8 connected to said insert pipe 3, an air introducing port 9 provided at the bottom of said external cylinder 1 located between said external cylinder 1 and said internal cylinder 2, characterized in that hydrogen gas supplied to the inside of said internal cylinder 2 via said insert pipe 3 from said hydrogen introducing port 8 is combusted by the air introduced into said internal cylinder 2 from said air introducing port 9 through the gap between said external cylinder 1 and said internal cylinder 2 with catalytic action of hydrogen combustion catalyst 4 pre-heated to an ambient atmosphere of over catalytic reaction temperatures by said preheating heater 5 so as to be discharged as safe water vapor.

In one specific embodiment of the present invention, the position of the top of said insert pipe 3 is at the height of 50-90% of the height of said internal cylinder 2 from the bottom thereof.

In another specific embodiment of the present invention, a lid 10 of non-porous metal plate is provided at the top of said insert pipe 3 and the same kind of catalyst 11, as said hydrogen combustion catalyst 4 filled in said internal cylinder 2, is packed up to the part corresponding to 10-54% of the pipe length of said insert pipe 3 from the top of said insert pipe 3.

In yet another specific embodiment of the present invention, the diameter of said internal cylinder 2 is determined so that the gap between said external cylinder 1 and said internal cylinder 2 corresponds to 5-17% of the diameter of said external cylinder 1, in said hydrogen combustion system.

In a further specific embodiment of the present invention, the height of said pre-heating heater 5 is made to the same with or higher than the top of said insert pipe 3, in said hydrogen combustion system.

DETAILED DESCRIPTION OF THE INVENTION

Figure 1:
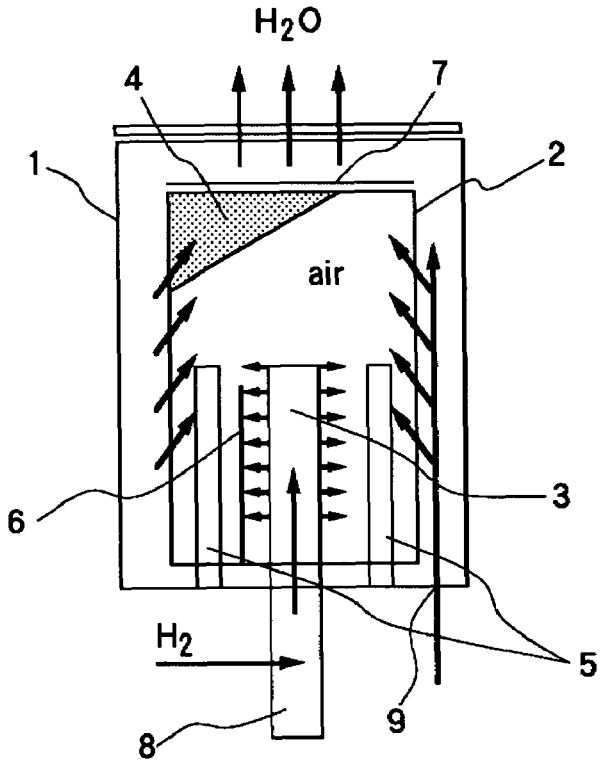
FIG. 1 is an overall view of the hydrogen combustion system by the present invention.
Figure 2:
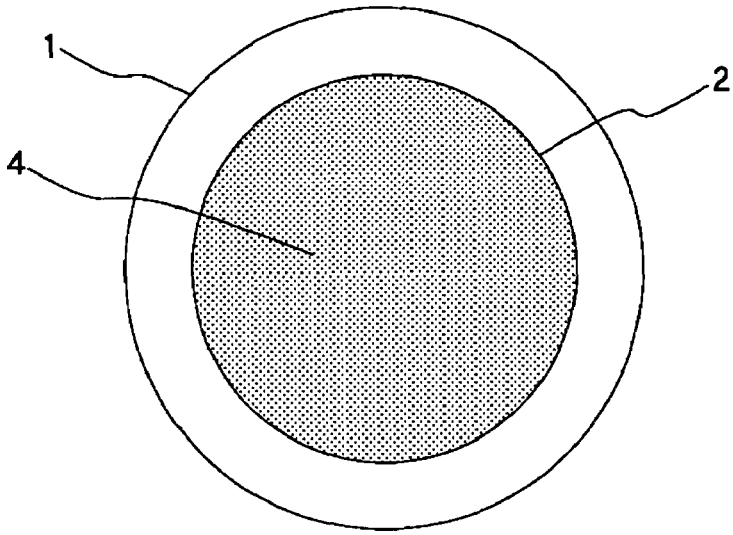
FIG. 2 is an upper section of the hydrogen combustion system by the present invention.

The following explains embodiments of the present invention based on FIG. 1. FIG. 1 is an overall view of the hydrogen combustion system by the present invention and FIG. 2 is a detailed picture of the upper section of it, in which 1 is the external cylinder constituting the exterior of the double tube construction, 2 is the internal cylinder constituting the interior of said double tube construction, formed by a porous metal plate, 3 is the insert pipe inserted in the center of said internal cylinder 2, formed by a porous metal plate, 4 is hydrogen combustion catalyst supported by one or more kinds of alloy or mixture of precious metal including platinum and palladium on the surface of the spherical ceramic supports like alumina, being formed in pellet and packed in said internal cylinder 2, 5 is the pre-heating heater to heat hydrogen combustion catalyst 4 to the ambient atmosphere of over catalytic reaction temperatures, being installed between said insert pipe 3 and said internal cylinder 2, 6 is a thermo couple for temperature control, 7 is a lid formed by a porous metal plate provided at the upper part of the internal cylinder 2, 8 is a hydrogen introducing port connected to the insert pipe 3, and 9 is an air introducing port provided at the bottom of the external cylinder 1 to intake air for hydrogen combustion into the gap between the external cylinder 1 and the internal cylinder 2.

According to the present invention, by-produced hydrogen from the processes including electrolysis and chemical reactions is supplied from the hydrogen introducing port 8 via the insert pipe 3 formed with a porous metal plate to the internal cylinder 2 formed with a porous metal plate, in the state of pure hydrogen without being concentrated or compressed by a blower, etc. and the air necessary for the combustion reaction of hydrogen is introduced from the air introducing port 9 to the inside of the internal cylinder 2 via the gap between the external cylinder 1 and the internal cylinder 2. On the other hand, hydrogen combustion catalyst 4 is preheated by the pre-heating heater 5 to ambient atmosphere of over catalyst reaction temperatures, and hydrogen gas and air introduced to the inside of the internal cylinder 2 are reacted by catalytic action in contact with hydrogen combustion catalyst 4 to be vented as safe water vapor. In this case, since the hydrogen gas is in pure non-diluted state, air introduced to the internal cylinder 2 must contain adequate amount of oxygen necessary for the reaction with hydrogen, unlike the catalytic combustion treatment method for the hydrogen diluted to a concentration below the explosion limit.

The internal cylinder 2, packed with hydrogen combustion catalyst is formed by a porous metal plate, to which air is supplied by drift effect resulting from the effect of negative pressure caused by hydrogen gas flow inside the internal cylinder 2. Between the external cylinder 1 and the internal cylinder 2 of the hydrogen combustion system, a certain gap is provided for air to be introduced from the side of the internal cylinder 2 to the inside of the internal cylinder 2. The gap between the external cylinder 1 and the internal cylinder 2 is desirably in the range of 5-17% of the diameter of the external cylinder 1, considering the down-sizing of the hydrogen combustion system and heat radiation to the external cylinder.

Since even if air is supplied, catalytic combustion does not occur unless ambient atmosphere of over catalytic reaction temperatures is prepared, it is necessary for the catalyst packed in the internal cylinder 2 to be pre-heated to a certain level of temperature. For this purpose, a rod type pre-heating heater 5 and a thermo couple for temperature control 6 are inserted into the internal cylinder 2 via the attachment washer provided at the bottom of the internal cylinder 2.

The time required for the packed catalyst to be heated to said temperatures varies with the number of the rod type pre-heating heaters 5, the heat capacity and the length of the heater, and therefore a suitable number of the heater rods, heat capacity and length of the heater must be chosen. In choosing these, electric power consumption of the system and life of heaters must also be taken into account.

As the hydrogen combustion catalyst 4 to be charged, pellet-state catalyst supported with precious metals on the sphere ceramic support surface is used. Such conformation is required to promote multidirectional diffusion of air. In general, the smaller the diameter of the granule, the larger will be the contact area between the gas to be treated and the catalyst. However, in the present system in which air is supplied to the internal cylinder, a proper grain diameter must be selected. Considering availability of a proper grain size from among commercial products, catalyst of 6 mm in mean particle size is desirable. As to the kind of precious metal to be supported on the ceramic, those commonly used as oxidation catalyst like platinum, palladium or the mixture thereof are desirably accepted.

The supply of hydrogen into the internal cylinder 2 is performed via the insert pipe 3 formed by a porous metal plate with the same purpose with the internal cylinder 2 of uniform dispersion of hydrogen inside the internal cylinder 2. As the hydrogen treatment volume varies with the pipe length, pipe diameter, etc. of the insert pipe 3, the optimum conformation has to be selected. If the insert pipe 3 is short in pipe length and the position of the pipe top is low, the surface area for hydrogen gas blow-out becomes small, causing a faster velocity of hydrogen gas blowing out of the insert pipe 3 to the internal cylinder 2, which leads to a phenomenon that hydrogen gas in non-reacted state leaks from the side of the internal cylinder 2 due to insufficient contact of hydrogen gas with catalyst. Moreover, in this case, the reaction utilization ratio of catalyst at the upper part of the insert pipe 3 also becomes low.

On the contrary, if the pipe length of the insert pipe 3 is unnecessarily long and the position of pipe top is too high, the surface area for hydrogen blow-out from the insert pipe 3 becomes large and the velocity of hydrogen blow-out from the insert pipe 3 into the internal cylinder 2 can be kept small and uniform hydrogen gas flow-out in the direction of height of the internal cylinder 2 can be maintained; but since the distance between the position of hydrogen blow-out of the insert pipe 3 and the exit of the internal cylinder becomes short, it may be possible that hydrogen will leak from the exit of the internal cylinder 2 in the state of non-reacting.

Figure 3:
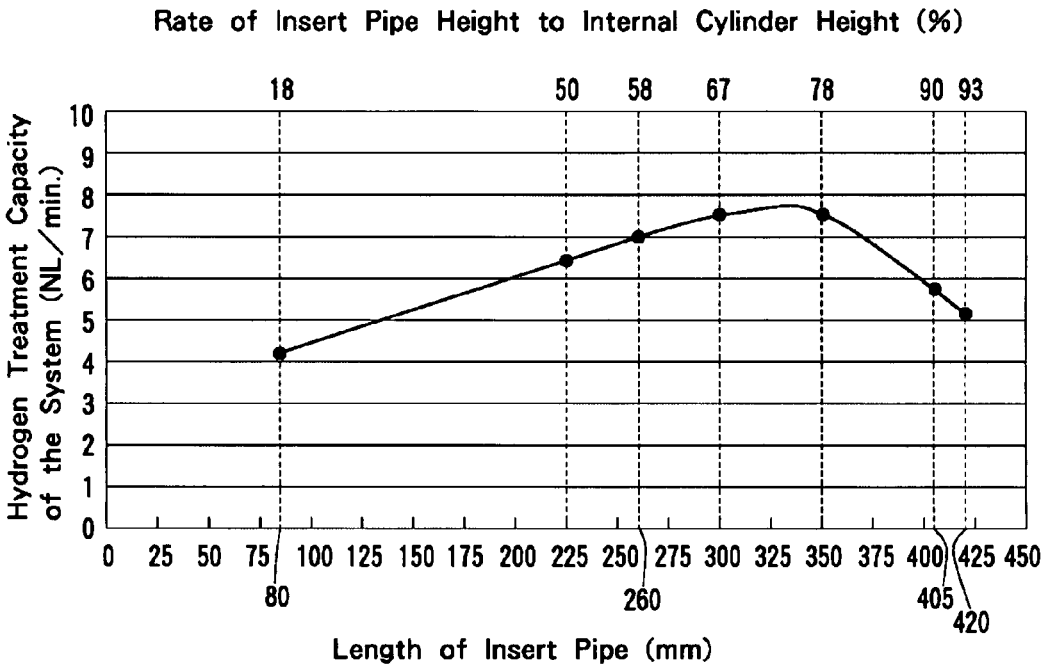
FIG. 3 shows the relation of the pipe length of the insert pipe 3 vs. the hydrogen treatment capacity of the hydrogen combustion system.

Therefore, in order to obtain the maximum hydrogen treatment capacity, it is necessary to keep an optimum balance among such factors as the velocity of hydrogen gas blow-out from the insert pipe 3 into the internal cylinder 2, the position of hydrogen gas blow-out from the insert pipe 3, and the distance between the top of the insert pipe 3 and the exit of the internal cylinder 2. From many experiments, it, has been proven that the maximum hydrogen treatment capacity can be obtained, as FIG. 3 shows, in the case where the pipe top of the insert pipe 3 is at the height of 50-90% from the bottom of the internal cylinder 2. These areas have been proven in the results of many experiments.

Figure 4:
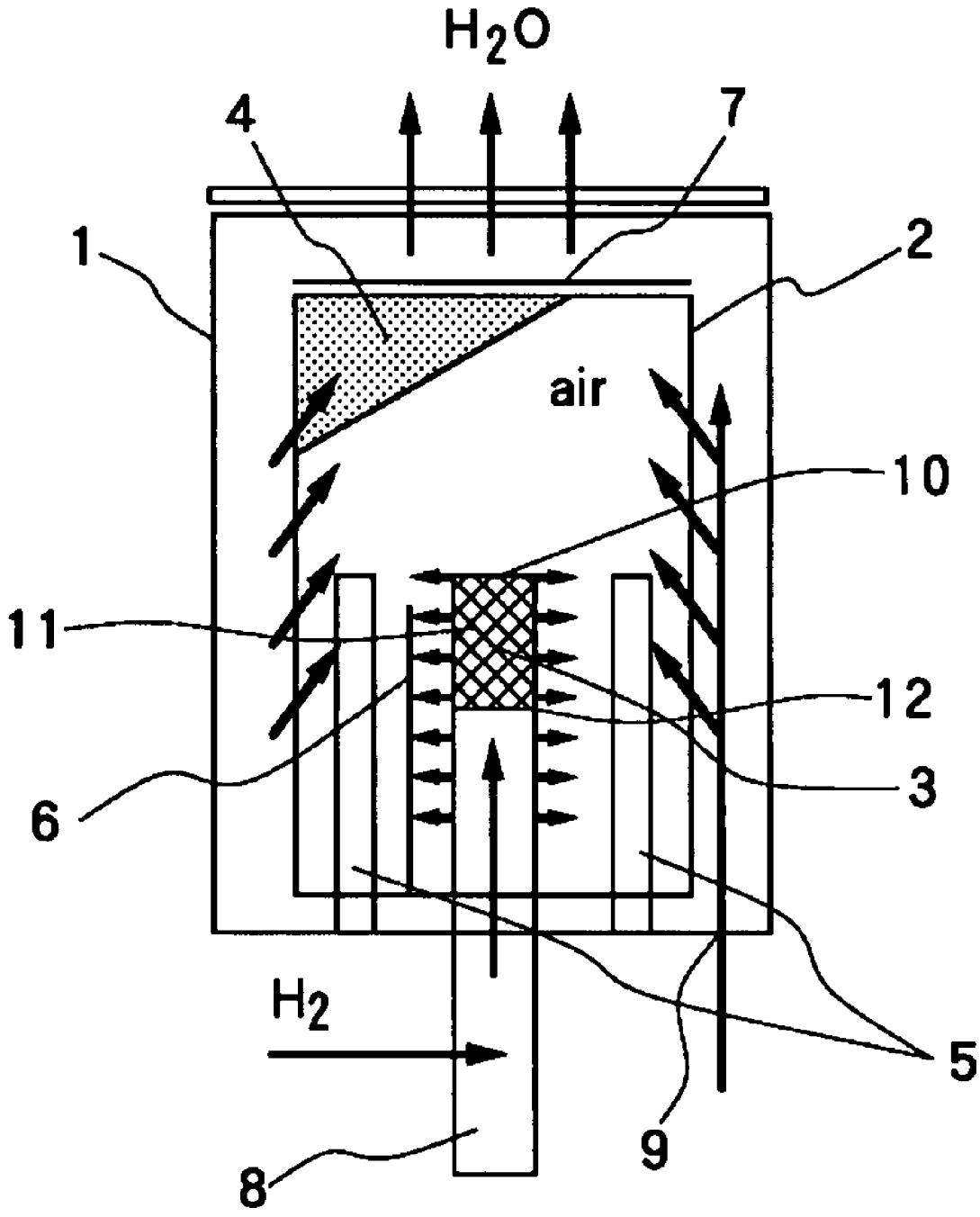
FIG. 4 is an overall view of another example of the hydrogen combustion system by the present invention.

In the present invention, the same kind of hydrogen combustion catalyst 11 as hydrogen combustion catalyst 4 packed in the internal cylinder 2 can also be packed at the top in said insert pipe 3, as shown in FIG. 4. The hydrogen combustion catalyst 11 is pellet-state catalyst supported with alloy or mixture of one or more kinds of precious metals including platinum and palladium on the sphere ceramic support surface, being packed up to the part corresponding to 10-54% of the pipe length of the insert pipe 3 from the top of said insert pipe 3, and held in the insert pipe 3 by a plain-woven mesh 12. The catalyst 11 is the same with or similar to the hydrogen combustion catalyst packed in the internal cylinder 2.

According to the present invention, a lid 10 formed by a non-porous metal plate is provided at the top of the insert pipe 3 and the system is designed in a way that hydrogen blows out from sides of the insert pipe 3, contributing to an enhanced hydrogen treatment capacity. Simultaneously, according to the present invention, the catalyst 11 which is the same as the catalyst charged in the internal cylinder is packed at the upper part of said insert pipe 3 and held by a plain-woven SUS 304 mesh 12 in a way that the catalyst does not move or fall down within the pipe. The reason why the catalyst 11 is fixed with a plain-woven mesh 12 is that hydrogen gas must be allowed to flow also into the catalyst packed part and therefore, the type of the fixture is not necessarily limited to the plain-woven mesh.

Within the insert pipe 3, hydrogen gas, being high in upward linear mobility due to the specific gravity of the gas and chimney effect tends to flow out of the upper part of the insert pipe 3. Then, according to the present invention, the catalyst 11 is charged within the insert pipe, which increases pressure drop within the pipe more, compared with non-charging at the catalyst packed part, and as a result, the range of hydrogen gas blow-out from the sides of the insert pipe 3 grows wider in the direction of height than at non-charging, and the hydrogen gas blow-out volume into the internal cylinder 2 becomes unified on the sides of the insert pipe 3.

However, if the catalyst packed area shares a small portion to the pipe length of the insert pipe 3, the effect cannot be obtained adequately; while contrarily if the area shares a large portion, the pressure drop within the pipe increases excessively and the hydrogen gas blow-out position moves downward from the optimum position, leading to deteriorated performance.

Figure 5:
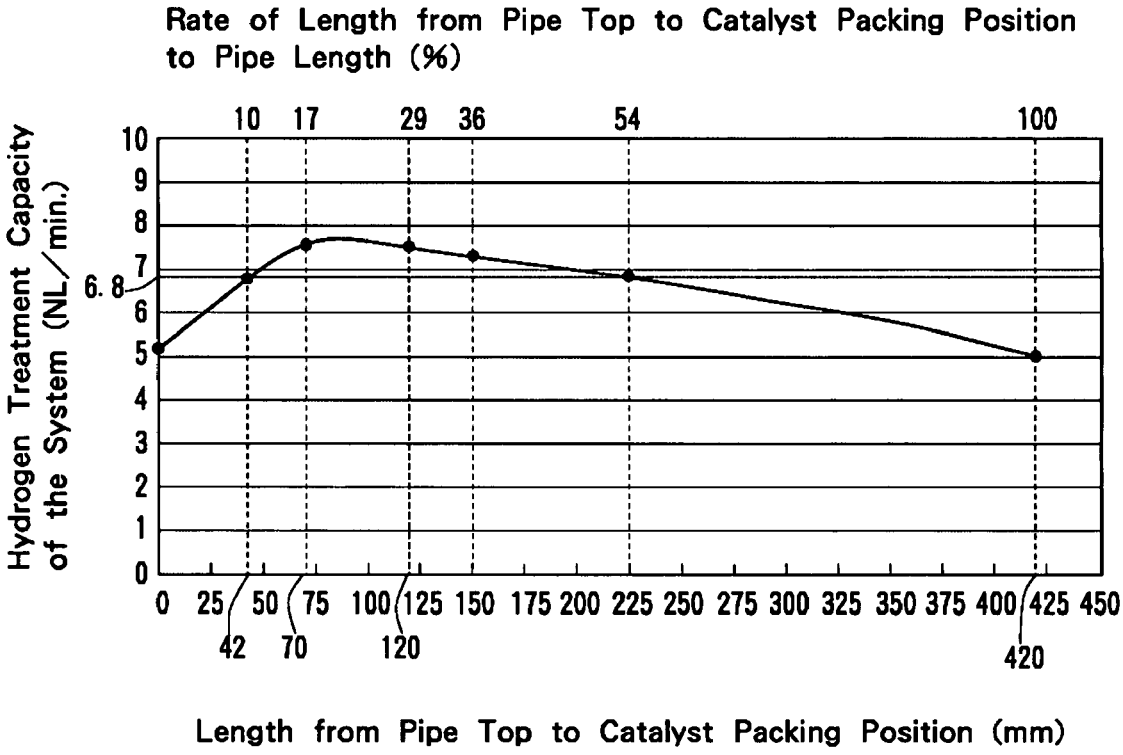
FIG. 5 shows the relation of the hydrogen treatment capacity vs. the catalyst packing position of the hydrogen combustion system by the present invention.

Therefore, it has been proven in many experiments as shown in FIG. 5, that for the maximum hydrogen treatment capacity, the catalyst 11 should be packed up to the point corresponding to 10-54% of the pipe length from the top of the insert pipe 3. These areas have been obtained from the results of many experiments, the results of which indicate, as given in the examples to be described, that hydrogen combustion efficiency is not high enough in the range of below 10% or above 54%.

On the other hand, as a matter of fact, increase in the catalyst volume leads to increase in hydrogen volume to be treatable, but in said hydrogen combustion system, the inflow air in the gap between the external cylinder and the internal cylinder is taken into the inside of the internal cylinder from its side surface, and therefore, if said gap is excessively narrow, the inflow air volume decreases and adequate air volume required for the reaction with hydrogen gas cannot be maintained.

Accordingly, the method of increasing the diameter of the internal cylinder and increasing the catalyst volume packed in the internal cylinder, within a range not leading to insufficient volume of the inflow air should be effective to an enhanced hydrogen treatment performance.

Also, if hydrogen gas volume flowing into the system increases, the velocity of hydrogen gas flowing into the internal cylinder 2 from the insert pipe 3 increases and such phenomenon may occur that the introduced hydrogen gas may leak from the side of the internal cylinder in the state of non-reacted due to insufficient contact with catalyst. For preventing such phenomenon from occurring, it is effective that the diameter of the internal cylinder 2 is increased and the distance from the insert pipe 3 to the side surface of the internal cylinder is prolonged.

As a result of discussion through many experiments by the inventors of the present invention, it has been proved that for the maximum hydrogen treatment volume, the cylinder diameter of the internal cylinder 2 should be determined so that the gap between the external cylinder 1 and the internal cylinder 2 constitutes 5-17% of the diameter of said external cylinder.

Also, the inserted pre-heating heater 5 is desirably as high as or higher than the insert pipe 3. If the inserted pre-heating heater 5 is low in height, and if the catalyst temperature in the vicinity of hydrogen gas blow-out is not sufficiently high enough for the reaction, right after the start of the system for hydrogen treatment, a large amount of hydrogen leakage will occur at the start of hydrogen treatment. Namely, if the height of the pre-heating heater 5 is lower than the top of the insert pipe 3, the catalyst packed in the portion higher than the pre-heating heater 5 is not expected to be pre-heated, and then the hydrogen gas blowing out from the insert pipe 3 into the internal cylinder right after the start of hydrogen treatment at the upper part than the height of the pre-heating heater 5 is allowed to leak in the non-reacted state due to the low temperature of the catalyst at said area.

Also, the pore diameter of the porous metal plate forming the insert pipe 3 must be smaller than the catalyst diameter of the hydrogen combustion catalyst 4 so that the pore of the porous metal plate forming the insert pipe 3 is not blocked with the hydrogen combustion catalyst 4. The diameter of hydrogen combustion catalyst 4 is desirably in the range of 4 mm to 6 mm, and the diameter of the pore of the porous metal plate forming the insert pipe 3 must be smaller than that of hydrogen combustion catalyst 4 and the pores are pitched desirably at non-integral multiple interval so as to be out of alignment with packed catalyst or are desirably opened at random. As far as these conditions are satisfied, the porous metal plate forming the insert pipe 3 can be alternatively perforated metals, plain-woven plates or metal fiber sintered objects in the shape of oval figure, rectangle or mesh without any limitation in conformation.

The constituent materials of the hydrogen combustion system by the present invention are those with high thermal resistance, high hydrogen embrittlement resistance and high corrosive resistance to cope with the high temperatures atmosphere, hydrogen atmosphere and water vapor atmosphere, caused by the combustion reaction inside the system. Considering cost and workability, and high level of resistivities being required as well, such materials as SUS304 are desirable Hydrogen gas supplied to the internal cylinder 2 packed with hydrogen combustion catalyst 4 is reacted with oxygen contained in externally introduced air through catalytic combustion and the formed water vapor is vented from the exit at the top of the system by convection. Vent water vapor may be heated to a high temperature, depending on the hydrogen volume to be treated and the operation time and therefore, some measures against burning injury and thermal loss must be taken. Also, by thermal radiation of the internal cylinder to the external cylinder during hydrogen treatment reaction, the surface temperature of the external cylinder will rise high, and any thermal insulation coating is required.

The following explains examples of the present invention. However, the present invention is not limited to these examples.

EXAMPLE 1

Using a system by the present invention shown in FIG. 1 and FIG. 2, about 3 liters of spherical-shape hydrogen combustion catalyst 4 with a mean spherical diameter of 6 mm supported with platinum and palladium is packed in the internal cylinder 2 with a cylindrical diameter of 100 mm and a cylindrical length of 450 mm. The pipe length and the diameter of the insert pipe are 260 mm and 45 mm, respectively. The system by the present invention was operated under the above-mentioned conditions and gave the result that when the introduced hydrogen gas flow rate was at 4.2 NL/min., the hydrogen concentration at the system exit was 0 ppm and completely combusted hydrogen gas was vented safely as water vapor.

EXAMPLE 2

Using a system by the present invention shown in FIG. 1 and FIG. 2, about 3 liters of spherical-shape hydrogen combustion catalyst 4 with a mean spherical diameter of 6 mm supported with platinum and palladium on the ceramic support surface is packed in the internal cylinder 2 with a cylindrical diameter of 100 mm and a cylindrical length of 450 mm formed with perforated metal. At this time, the insert pipe 3 was formed with perforated metal in the same way as the internal cylinder 2. The shape of the pore of the insert pipe 3 was round and its diameter was 3 mm. The diameter of the insert pipe 3 was 45 mm and 7 kinds of the insert pipe 3 with different lengths: 80 mm, 225 mm, 260 mm, 300 mm, 350 mm, 405 mm, 420 mm were prepared. Using these 7 kinds of the insert pipe 3, the following experiments were conducted. Catalyst in the internal cylinder was heated to the predetermined temperature by the pre-heating heater 5 and then hydrogen gas by-produced in an electrolytic ozone water production unit was supplied into the internal cylinder from the insert pipe 3. The height of the pre-heating heater 5 was at the same with the top of the insert pipe 3.

The flow rate of hydrogen gas flowing into the hydrogen combustion system was controlled by means of setting the electrolytic current value of the electrolytic ozone water production unit.

Table 1 and FIG. 3 show the relation of the pipe length of the insert pipe 3 vs. hydrogen treatment capacity of the hydrogen combustion system.

TABLE 1

| Length of Insert Pipe (mm) | Rate of Insert Pipe Height to Internal Cylinder Height (%) | Hydrogen Treatment Capacity of the System (NL/Min) |
|---|---|---|
| 80 | 18 | 4.2 |
| 225 | 50 | 6.4 |
| 260 | 58 | 7.0 |
| 300 | 67 | 7.6 |
| 350 | 78 | 7.5 |
| 405 | 90 | 5.9 |
| 420 | 93 | 5.1 |

Here, the hydrogen treatment capacity given by the vertical axis is the maximum hydrogen flow rate at which no hydrogen is detected by the hydrogen sensor as measured right after the exit of the system, that is, at which hydrogen is treated completely to water vapor. It has been proved from Table 1 and FIG. 3 that the hydrogen treatment capacity reaches its peak in the range from the pipe length 225 mm at which the pipe top of the insert pipe 3 is at 50% of the height of the internal cylinder 2 to the pipe length 405 mm at which the pipe top of the insert pipe 3 is at 90% of the height of the internal cylinder 2.

EXAMPLE 3

The present invention was implemented using a system by the present invention shown in FIG. 4.

About 3 liters of spherical-shape hydrogen combustion catalyst 4 with a mean spherical diameter of 6 mm supported with platinum and palladium on the ceramic support surface is packed in the internal cylinder 2 with a cylindrical diameter of 100 mm and a cylindrical length of 450 mm formed with a perforated metal. At this time, the insert pipe 3 was formed with a perforated metal in the same way as the internal cylinder 2. The shape of the pore of the insert pipe 3 was round and its diameter was 3 mm. The diameter of the insert pipe 3 was 45 mm and the pipe length was 420 mm. Catalyst in the internal cylinder was heated to the predetermined temperature by the pre-heating heater 5 and then after preheating, hydrogen gas by-produced in an electrolytic ozone water production unit was supplied into the internal cylinder from the insert pipe 3. The height of the pre-heating heater 5 was at the same with the top of the insert pipe 3. The external cylinder 1 was formed by SUS 304 metal plate and the cylinder diameter was 150 mm. At the top of the insert pipe 3, a lid 10 formed by non-porous metal plate was provided. Experiments were carried out in the way that spherical-shape hydrogen combustion catalyst 11 with a mean spherical diameter of 6 mm supported with platinum and palladium on the ceramic support surface is packed in the inserted pipes 3 to the depth of 42 mm, 70 mm, 120 mm, 150 mm, 225 mm, and 420 mm, respectively, from the top of the pipe. Said catalyst 11 and the catalyst 4 in the internal cylinder 2 were heated to 120 degrees Celsius by the pre-heating heater 5 and then after the preheating, hydrogen gas by-produced in an electrolytic ozone water production unit was supplied into the internal cylinder from said insert pipe. When the length of the insert pipe 3 is 420 mm, the positions of 42 mm, 70 mm, 120 mm, 150 mm, 225 mm, and 420 mm from the top of the pipe correspond, respectively, to 10%, 17%, 29%, 36%, 54%, and 100% of the pipe length of the insert pipe 3 from the top of the pipe. The flow rate of hydrogen gas flowing into the system was controlled by means of setting the electrolytic current value of the electrolytic ozone water production unit.

The relation between the catalyst packing position in the insert pipe 3 and the hydrogen treatment capacity of the system by the present invention is shown in Table 2 and FIG. 5. Here, the hydrogen treatment capacity given by the vertical axis is the maximum hydrogen flow rate at which no hydrogen is detected by the hydrogen sensor as measured right after the exit of the system, that is, at which hydrogen is treated completely to water vapor. It has been proved from FIG. 5 that the hydrogen treatment capacity reaches the highest efficiency of 6.8 NL/min. or more in the range from 42 mm from the pipe top of the insert pipe 3 which corresponds to 10% of the pipe length of the insert pipe 3 to 225 mm from the pipe top of the insert pipe 3 which corresponds to 54% of the pipe length of the insert pipe 3.

TABLE 2

The relation between the catalyst packing position in the insert pipe and the hydrogen treatment capacity of the system

| Length from Pipe Top to Catalyst Packing Position (mm) | Rate of Length from Pipe Top to Catalyst Packing Position to Pipe Length (%) | Hydrogen Treatment Capacity of the System (NL/Min.) |
|---|---|---|
| 42 | 10 | 6.8 |
| 70 | 17 | 7.55 |
| 120 | 29 | 7.48 |
| 150 | 36 | 7.25 |
| 225 | 54 | 6.8 |
| 420 | 100 | 5.04 |

EXAMPLE 4

Using a system by the present invention shown in FIG. 4, about 3 liters of spherical-shape hydrogen combustion catalyst 11 with a mean spherical diameter of 6 mm supported with platinum and palladium on the ceramic support surface is packed in the internal cylinder 2 formed by a perforated metal with the cylindrical diameter of 100 mm and a cylindrical length of 450 mm, where the pipe length and the pipe diameter of the insert pipe 3 equipped with a metal plate lid at the top were 350 mm and 38 mm, respectively. At this time, the insert pipe 3 is provided at the top with a lid 10 formed by non-porous metal plate and spherical-shape hydrogen combustion catalyst 11 with a mean spherical diameter of 6 mm supported with platinum and palladium on the ceramic support surface is packed in the insert pipe 3 up to 42 mm from the top of the pipe. Then, the catalyst 11 in the insert pipe 3 and the catalyst 4 in the internal cylinder 2 were heated to 120 deg.C. by the pre-heating heater 5, and then after the preheating, hydrogen gas by-produced from an electrolytic ozone water production unit was supplied into the internal cylinder from said insert pipe. The external cylinder 1 is formed by SUS 304 metal plate with the cylinder diameter of 150 mm. Under these conditions, the gap between the external cylinder 1 and the internal cylinder 2 is about 15% of the diameter of said external cylinder. This figure can be calculated by the following equation. 150 mm−100 mm=50 mm, 50 mm÷2=25 mm, 25 mm÷150 mm×100=17%

Also, about 5.4 liters of spherical-shape hydrogen combustion catalyst 11 with a mean spherical diameter of 6 mm supported with platinum and palladium on the ceramic support surface is packed in the internal cylinder 2 formed by a perforated metal with the cylindrical diameter of 133 mm and a cylindrical length of 450 mm, where the pipe length and the pipe diameter of the insert pipe 3 equipped with a metal plate lid at the top were 350 mm and 38 mm, respectively.

In the insert pipe 3, spherical-shape hydrogen combustion catalyst 11 with a mean spherical diameter of 6 mm supported with platinum and palladium on the ceramic support surface was packed up to 42 mm from the top of the pipe. Then, the catalyst 11 in the insert pipe 3 and the catalyst 4 in the internal cylinder 2 were heated to 120 deg.C. by the pre-heating heater 5, and then after the pre-heating, hydrogen gas by-produced in an electrolytic ozone water production unit was supplied into the internal cylinder from said insert pipe. The conformation of the external cylinder 1 was same as that above-mentioned. Under these conditions, the gap between the external cylinder 1 and the internal cylinder 2 is about 5% of the diameter of said external cylinder. This figure can be calculated by the following equation. 150 mm−133 mm=17 mm, 17 mm÷2=8.5 mm, 8.5 mm÷150 mm×100=5%

The flow rate of hydrogen gas flowing into the system was controlled by means of setting the electrolytic current value of the electrolytic ozone water production unit.

Figure 6:
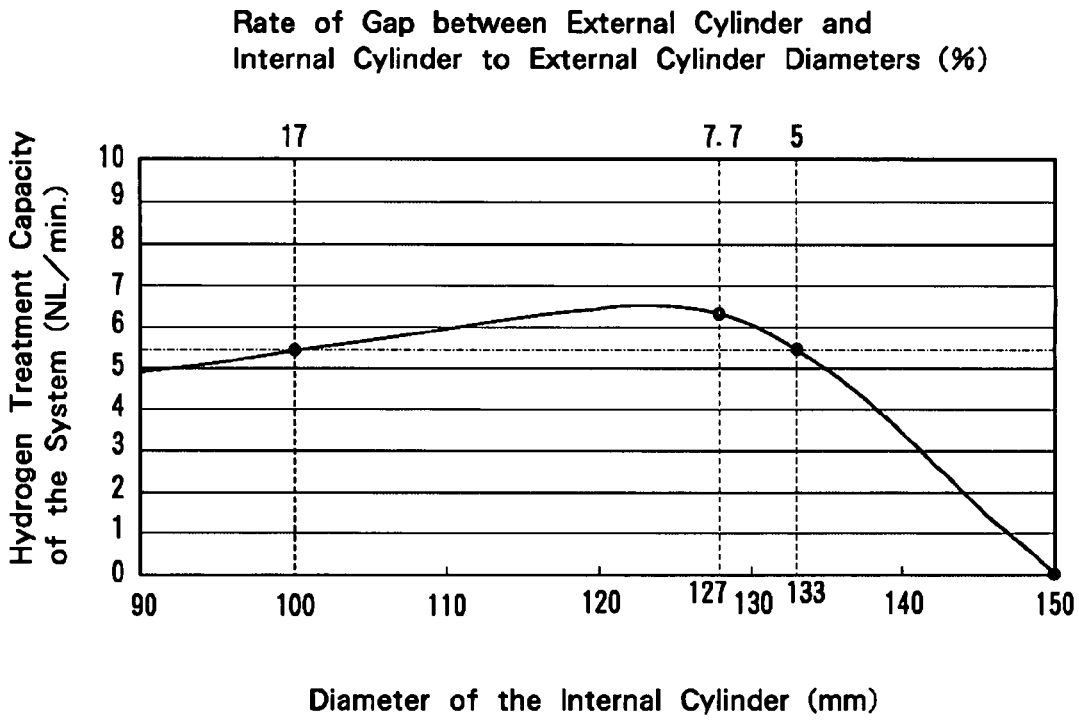
FIG. 6 shows the relation of the hydrogen treatment capacity vs. the diameter of the internal cylinder of the hydrogen combustion system by the present invention.
Figure 7:
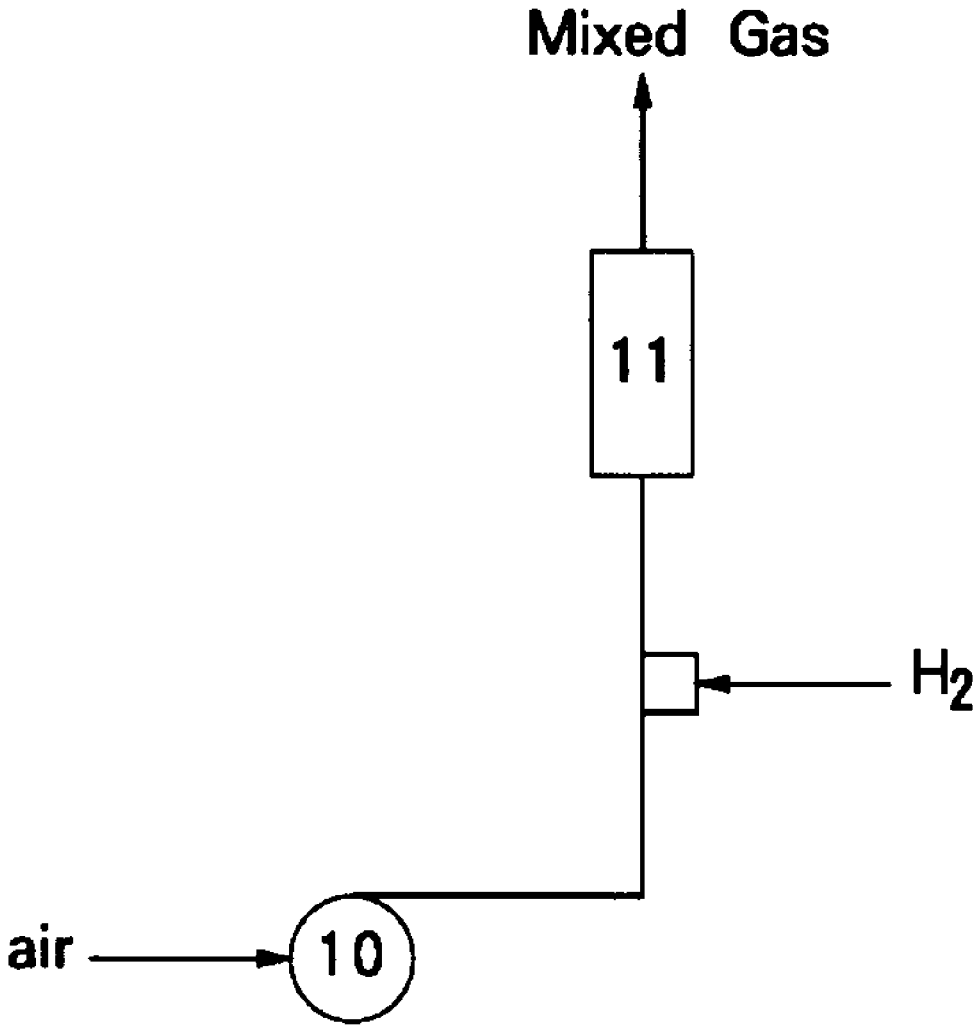
FIG. 7 PRIOR ART
FIG. 7 shows a conventional hydrogen combustion system.
Figure 8:
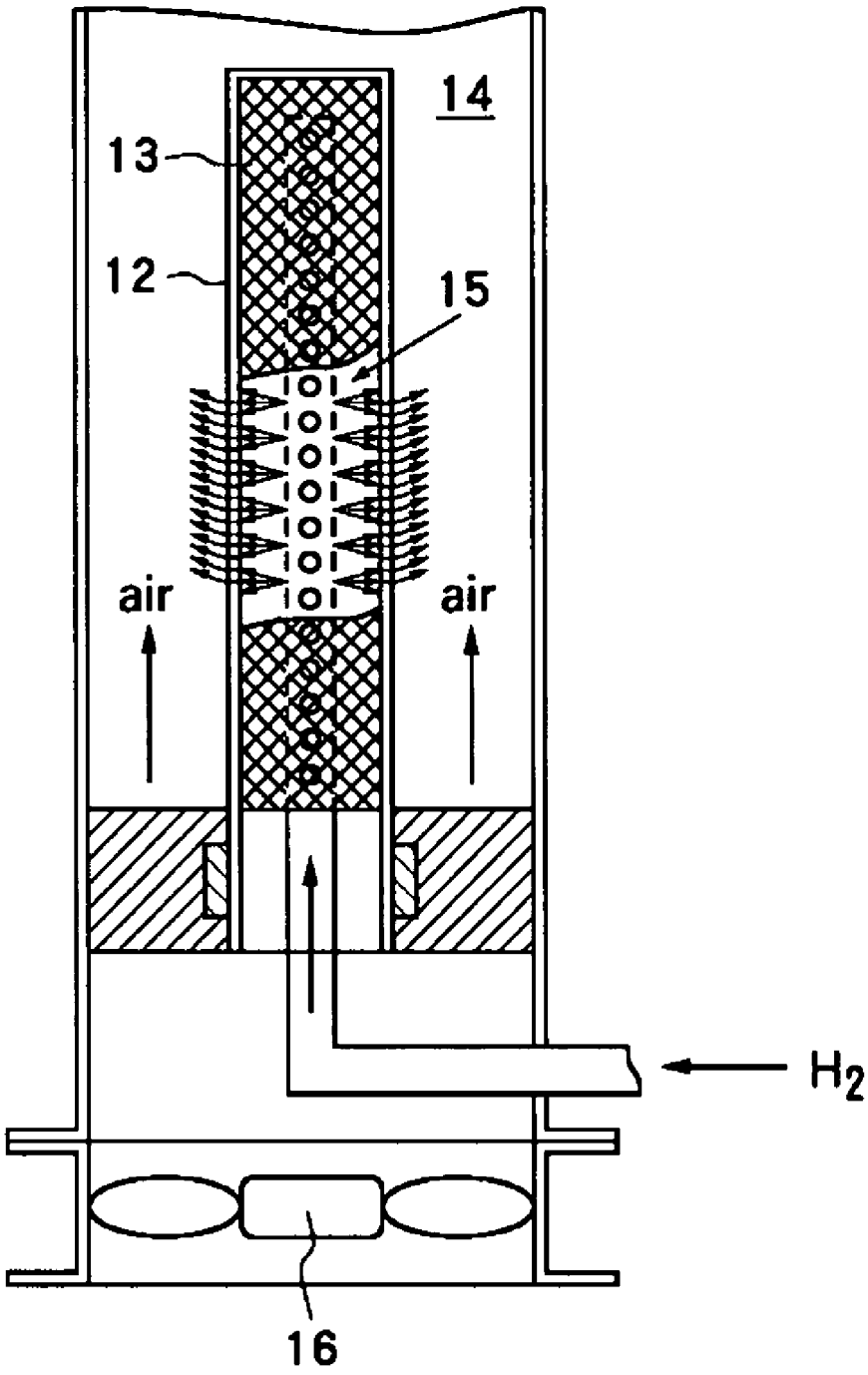
FIG. 8 PRIOR ART
FIG. 8 shows another conventional hydrogen combustion system.

The relation between the diameter of the internal cylinder 2 and the hydrogen treatment capacity of the system by the present invention is shown in Table 3 and FIG. 6. The hydrogen treatment capacity given by the vertical axis is the maximum hydrogen flow rate at which no hydrogen is detected by the hydrogen sensor as measured right after the exit of the system, that is, at which hydrogen is treated completely to water vapor. It has been proved from Table 3 and FIG. 6 that the hydrogen treatment capacity reaches the highest efficiency when the cylinder diameter of the internal cylinder 2 is in the range from 100 mm at which the gap between the external cylinder 1 and the internal cylinder 2 corresponds to 17% of the external cylinder diameter to 133 mm at which said gap corresponds to 5% of the external cylinder diameter.

TABLE 3

The relation between the diameter of the internal cylinder and the hydrogen treatment capacity of the system

| Diameter of the Internal Cylinder (mm) | Rate of Gap between External Cylinder and Internal Cylinder to External Cylinder Diameter (%) | Hydrogen Treatment Capacity (NL/min.) |
|---|---|---|
| 100 | 17 | 5.33 |
| 127 | 7.7 | 6.26 |
| 133 | 5 | 5.33 |

The present invention relates to a hydrogen combustion system which treats hydrogen gas by means of combustion treatment with hydrogen combustion catalyst. Though having no restriction as to kinds of feed hydrogen gases to be combusted, the system is applicable to combust excess hydrogen generated during operation of fuel cells, atmospheric hydrogen at the film forming in semi-conductor processes, electrolytically by-produced hydrogen from a water electrolysis system, useless by-product hydrogen from chemical reaction processes, and is particularly suitable to combust hydrogen gas from the production units of electrolytic ozone gas and electrolytic ozone water, which feature relatively a small amount of by-product hydrogen flow.

According to the present invention, the feed hydrogen gas, exhausted as waste from the preceding processes, is supplied to the system as it is without being diluted and mixed with air to the lower limit of combustion range in a premixing step. The air necessary for the reaction with hydrogen is introduced by the drift from the differential pressure occurring between the packed layer of the hydrogen combustion catalyst and the outside, generated by concentration diffusion and thermal convection, which eliminates the necessity for installing a blower and a fan to feed air for reaction. Thus, this system can offer safe combustion treatment of hydrogen gas and advantages of simple construction, small size and high treatment efficiency. Also, according to the present invention, the maximum hydrogen treatment capacity is obtained by filling the catalyst 11 in the insert pipe 3, up to the point corresponding to 10-54% of the pipe length of the insert pipe 3 from the top.

Moreover, according to the present invention, the flow amount of hydrogen gas blowing out of the upper, side surface of the insert pipe 3 into the internal cylinder can be restrained and hydrogen gas is allowed to blow out relatively uniformly from the entire side surface of the insert pipe 3, by packing the same catalyst as that in the internal cylinder 2 in the insert pipe 3 up to 10-54% of pipe length of the insert pipe 3 from the top of it.

In addition, according to the present invention, when the diameter of the internal cylinder is determined so that the gap between the external cylinder and the internal cylinder corresponds to 5-17% of the diameter of said external cylinder, the balance between the catalyst volume packed in the internal cylinder 2 and the air volume flowing into the gap is optimized, and by doing this, the hydrogen treatment capacity can be enhanced and a hydrogen combustion system which is simple in construction, small in size and high in hydrogen treatment performance can be offered.

Also, according to the present invention, hydrogen can be combusted effectively by making the top of inserted preheating heaters 5 be the same as, or more than, the pipe top of the insert pipe 3.

This application claims the priorities of Japanese Patent Application 2006-206079 filed Jul. 28, 2006, Japanese Patent Application 2006-226347 filed Aug. 23, 2006 and Japanese Patent Application 2006-299993 filed Nov. 6, 2006, the teachings of which are incorporated herein by reference in their entirety.

The invention claimed is:

1. A hydrogen combustion system comprising: an external cylinder (1) constituting the exterior of a double tube construction; an internal cylinder (2) formed by a porous metal plate constituting the interior of said double tube construction; a hydrogen combustion catalyst (4) supported by precious metals on a spherical ceramic support surface, being formed in a pellet state and loaded in said internal cylinder (2); an insert pipe (3) formed by a porous metal plate inserted in the center of said internal cylinder (2); a lid (10) of a non-porous metal plate provided at the top of said insert pipe (3) and the same kind of catalyst (11) as said hydrogen combustion catalyst (4) being packed up to the part corresponding to 10-54% of the pipe length of said insert pipe (3) from the top of said insert pipe (3); a pre-heating heater (5) located between said insert pipe (3) and said internal cylinder (2) to preheat said hydrogen combustion catalyst (4) to an ambient atmosphere of over catalytic reaction temperatures; a hydrogen gas introducing port (8) connected to said insert pipe (3); and an air introducing port (9) provided at a bottom of said external cylinder (1) and located between said external cylinder (1) and said internal cylinder (2); characterized in that hydrogen gas supplied to said internal cylinder (2) from said hydrogen gas introducing port (8) via said insert pipe (3) is combusted with air introduced into said internal cylinder (2) from said air introducing port (9) through the gap between said external cylinder (1) and said internal cylinder (2), by catalytic action of the hydrogen combustion catalyst (4) preheated to an ambient atmosphere of over catalytic reaction temperatures by said preheating heater (5) so as to be discharged as safe water vapor.

2. A hydrogen combustion system according to claim 1, characterized in that the position of the pipe top of said insert pipe (3) is at a position in the range of 50-90% from the bottom of said internal cylinder.

3. A hydrogen combustion system according to claim 1, characterized in that the diameter of said internal cylinder (2) is determined so that the gap between said external cylinder (1) and said internal cylinder (2) corresponds to 5-17% of the diameter of said external cylinder (1).

4. A hydrogen combustion system according to claim 1, characterized in that the height of said pre-heating heater (5) is made to be the same with or higher than the top of said insert pipe (3).

* * * * *